US012005321B2

(12) United States Patent
Martinez

(10) Patent No.: US 12,005,321 B2
(45) Date of Patent: Jun. 11, 2024

(54) GOLF CLUB TOOL AND METHOD

(71) Applicant: Jesse Martinez, Reno, NV (US)

(72) Inventor: Jesse Martinez, Reno, NV (US)

( * ) Notice: Subject to any disclaimer, the term of this patent is extended or adjusted under 35 U.S.C. 154(b) by 126 days.

(21) Appl. No.: 17/329,054

(22) Filed: May 24, 2021

(65) Prior Publication Data

US 2021/0362009 A1 Nov. 25, 2021

Related U.S. Application Data

(60) Provisional application No. 63/029,469, filed on May 23, 2020.

(51) Int. Cl.

| | |
|---|---|
| ***A63B 47/02*** | (2006.01) |
| ***A63B 53/14*** | (2015.01) |
| ***A63B 57/30*** | (2015.01) |
| ***A63B 57/35*** | (2015.01) |
| ***A63B 57/50*** | (2015.01) |
| ***A63B 60/14*** | (2015.01) |

(52) U.S. Cl.

CPC ..... *A63B 47/02* (2013.01); *A63B 53/14* (2013.01); *A63B 57/35* (2015.10); *A63B 57/353* (2015.10); *A63B 57/50* (2015.10); *A63B 60/14* (2015.10); *A63B 2209/08* (2013.01); *A63B 2210/50* (2013.01)

(58) Field of Classification Search

CPC ..... A63B 47/02; A63B 57/35

See application file for complete search history.

(56) References Cited

U.S. PATENT DOCUMENTS

| | | | | | |
|---|---|---|---|---|---|
| 3,029,097 | A * | 4/1962 | Ward | A63B 47/02 | 294/19.2 |
| 3,922,026 | A * | 11/1975 | Schweitzer | A63B 60/38 | 294/19.2 |
| 4,136,901 | A * | 1/1979 | Walter | A63B 47/02 | 294/19.2 |
| 5,377,977 | A * | 1/1995 | MacNeary | A01B 1/24 | 473/286 |
| 5,413,329 | A * | 5/1995 | Hirsch | A63B 55/10 | 473/282 |
| 5,460,366 | A * | 10/1995 | Pugh | A63B 47/02 | 473/286 |
| 5,690,558 | A * | 11/1997 | Huber | A63B 47/02 | 473/285 |
| 5,899,511 | A * | 5/1999 | Dinatale | A63B 47/02 | 473/286 |
| 6,502,646 | B2 * | 1/2003 | Wiens | A63B 53/14 | 172/378 |
| 6,692,374 | B1 * | 2/2004 | Colbo | A63B 47/02 | 473/286 |

(Continued)

*Primary Examiner* — Eugene L Kim
*Assistant Examiner* — Christopher Glenn
(74) *Attorney, Agent, or Firm* — Long & Chybik; John D. Long, Esq.

(57) ABSTRACT

A golf club tool and method, the golf club tool comprises a tool body defining a hollow body interior that continuously connects an open first body end to an enclosed second body end, the hollow body interior is configured to removably receive and partially encapsulate a top portion of a golf club; the enclosed second body end removably supports a golf ball marker and further pivotally mounts a multi-prong fork; and the multi-prong fork is further configured to have a removable engagement with a golf ball.

20 Claims, 17 Drawing Sheets

(56) References Cited

U.S. PATENT DOCUMENTS

| | | | | |
|---|---|---|---|---|
| 7,850,539 | B2 | 12/2010 | Quinn | |
| 7,959,526 | B2 | 6/2011 | Petela | |
| 8,231,479 | B1 * | 7/2012 | McIntosh | A63B 69/3685 473/282 |
| 8,414,415 | B1 * | 4/2013 | Twohig | A63B 55/10 473/282 |
| 2005/0014572 | A1 * | 1/2005 | Lisby, Jr. | A63B 57/50 473/286 |
| 2006/0058109 | A1 * | 3/2006 | Wilson, III | A63B 57/0037 473/286 |
| 2007/0049396 | A1 * | 3/2007 | Scheibe | A63B 47/02 473/282 |
| 2009/0149270 | A1 * | 6/2009 | Nickel | A63B 47/02 473/286 |
| 2016/0346653 | A1 * | 12/2016 | Suwito | A63B 57/50 |

* cited by examiner

GOLF CLUB TOOL AND METHOD

CROSS-REFERENCES TO RELATED APPLICATIONS

Not Applicable.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to golf tools that may be affixed to or otherwise are incorporated into golf club. More particularity to those golf tools may be affix to or otherwise are incorporated into a golf club handle.

BACKGROUND

Golf may be a sport with a great and devoted following in older players. Older golfers' enthusiasm for the game may be further coupled with the time, the desire and the opportunity the older golfers that allow them to play the game as often as possible. With age however, there may come physical limitations to the older golfer's ability to engage in their beloved pastime. These limitations may appear in the two areas of golf, namely the long game (e.g., hitting the golf ball off the tee and subsequently driving the golf ball down the fairway to a respective green) and the short game (e.g., driving the golf ball onto the green and then putting the golf ball until the golf ball is driven into the green's hole or cup.) Generally, the golfer's long game may be impinged by such factors as diminished physical strength and swing capability needed for effective tee-off and subsequent fairway driving as well as the golfer's walking ability to traverse such distances. These long game limitations may be addressed by changing club selections and alternation of golfer's club swing, while walking limitations could be assisted by the appropriate use of a golf cart, use of caddie or both.

The impact of aging upon the short game can be seen upon the golfer's repeated need to bend over to remove ball impacts on the putting green (i.e., divot removal), placing and removal of the golf ball marker (e.g., allowing other player to putt through a marker identified location): and removal of the golf ball (e.g., from the respective green hole due to the sinking of the putt.) Older golfers may further experience back stiffness, dizziness and the like that may impair or possibly limit the amount of bending over that a golfer can accomplish upon the green and alike.

What could be needed could be a single device or tool that generally allows the older or physically impacted golfer to repeatedly pick up golf balls; deposit and remove ball makers to and from the green; and remove putting green divots without having to fully bend over to engage in such activities. Such a device could be multi-tooled to accomplish such different green related activities and be designed to be activated by the older golfer (e.g., older person's hands generally having less dexterity, grip capability, and friction interface.) Such a golf solution could further be attached to a golf club to allow the golfer to use the modified golf club as an extension to place the device proximate to the green (e.g., next to the divot, golf ball, golf ball marker and alike.)

SUMMARY OF ONE EMBODIMENT OF THE INVENTION

Advantages of One or More Embodiments of the Present Invention

The various embodiments of the present invention may, but do not necessarily, achieve one or more of the following advantages:

- to provide a golfing device that removably secures to or is incorporated into a grip of a golf club to allow the golf club to present the golfing device at least proximate to the ground such a surface of golfing tee, fairway or green;
- the ability to pick up golf balls, place and retrieve ball markers and repair green divots without having a golfer bend over to institute such actions;
- to provide a device enhanced golf club or a golfing device attached to a golf club handle, the said device generally having multiple tools to pick up golf balls, place and retrieve ball markers and repair green divots and without having the operator to bend over;
- the ability to provide a golf club such as putter with the capabilities of picking up golf balls, placing and retrieving ball markers and repairing green divots; and
- to provide a golf club device with a multi-tool capability that can be manipulated and operated with greater ease by an older golfer.

These and other advantages may be realized by reference to the remaining portions of the specification, claims, and abstract.

Brief Description of One Embodiment of the Present Invention

One possible embodiment of the invention could be a golf tool comprising: 1) a tool body defining a hollow body interior that removably receives and partially encapsulates a top portion of a golf club, the hollow body interior continuously connects to an open body end, the tool body further defines an enclosed body end located opposite of the open body end, the enclosed body end removably attaches a golf ball marker and further pivotally attaches a multi-prong fork.

Another possible embodiment of the invention could be a golfing tool and golfing club combination comprising a golf tool and golf club, the golf tool having a tool body supporting a securing device to removable secure the tool body to the golf club grip, the tool body having a hollow interior that removably receives and partially encapsulates a top portion of a grip of a golf club, the tool body further defines an enclosed body end, the enclosed body end further supporting a magnetically and removably attached golf ball marker and a pivotally attached multi-prong fork. Another possible embodiment of the invention could be a method of operating a golf club tool comprising the following steps: providing a tool body defining a hollow body interior that removably receives and partially encapsulates a top portion of a golf club; the hollow body interior continuously connects to an open first body end to an enclosed second body end; enclosed second body end removably attaches to a golf ball marker and further pivotally supports a multi-prong fork; the multiple prong fork further configured to have a removable engagement with a golf ball; providing a golf club having a top portion; inserting the top portion into the hollow body interior; pivoting the multiple prong fork away from tool body; and removably engaging a golf ball with the multiple prong fork.

The above description sets forth, rather broadly, a summary of one embodiment of the present invention so that the detailed description that follows may be better understood and contributions of the present invention to the art may be better appreciated. Some of the embodiments of the present invention may not include all the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized, and structural changes may be made without departing from the scope of the present invention.

Figure 1:
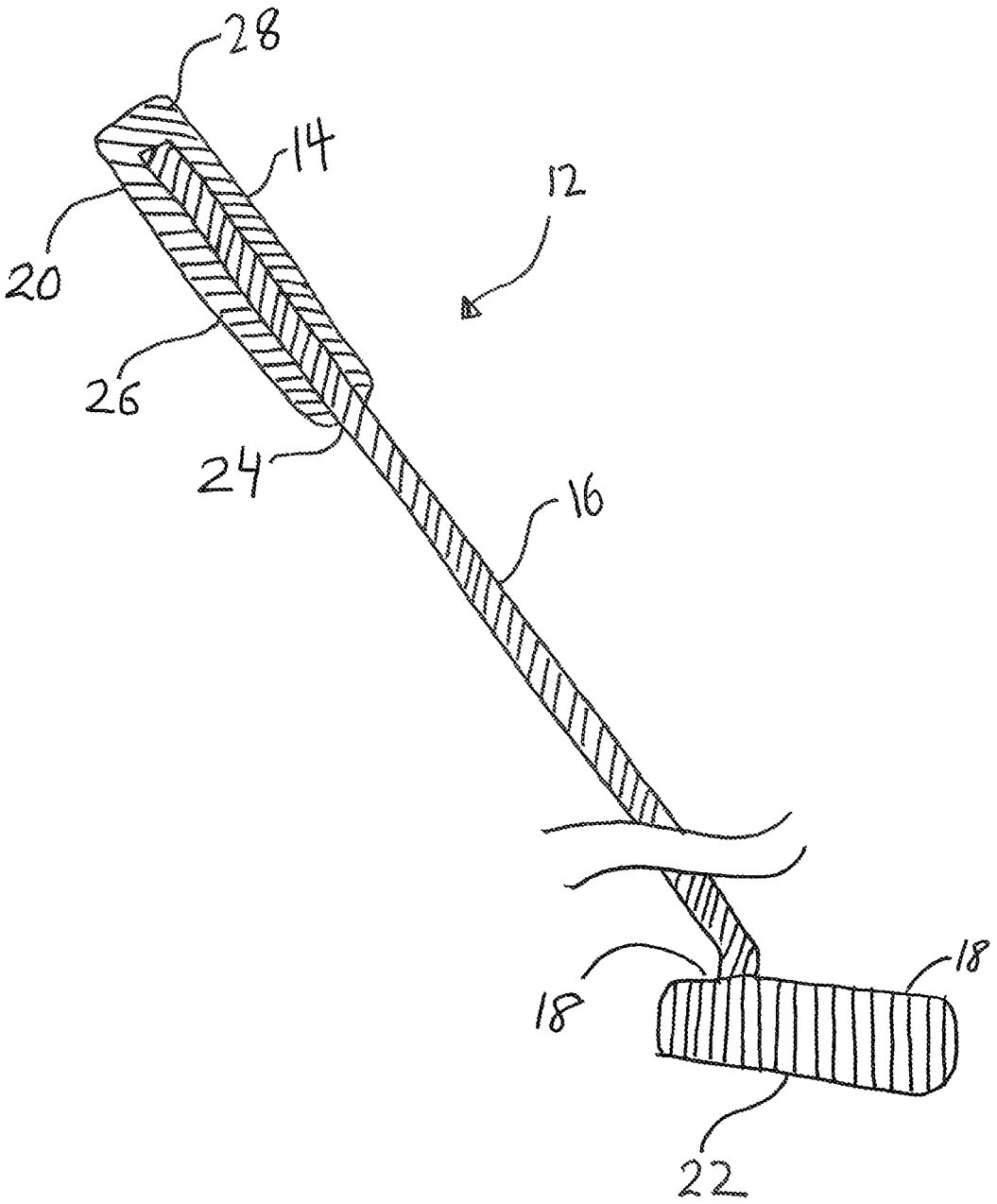
FIG. 1 is substantially an elevation view of a golf club.
Figure 15:
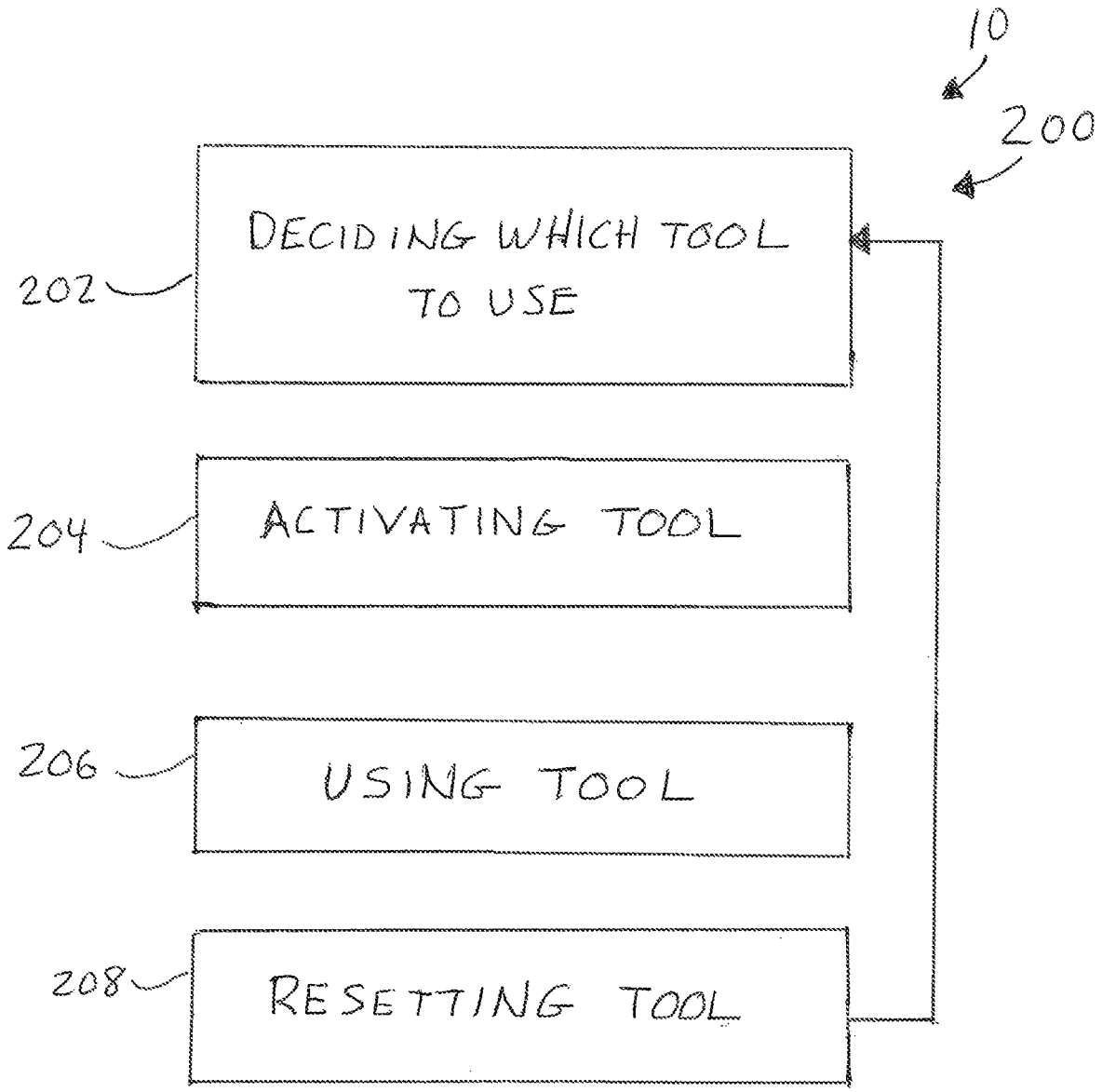
FIG. 15 is substantially a flowchart schematic showing one possible method or process of operating the invention.

The present invention 10 could comprise a golf club tool 40 (as substantially shown in FIG. 3) and a method or process of operation 200 (as substantially shown in FIG. 15.) The golf club tool 40 could attach to or be incorporated into a golf club handle 14 of a golf club 12. As substantially shown in FIG. 1, the golf club 12 could comprise a golf club shaft 16 having two ends, a first shaft end 18 to which the club head 22 is affixed and a second shaft end 20 which may be wrapped or otherwise may covered by a golf club handle 14. In this manner, an open handle end 24 of the club handle 14 may receive the second shaft end 20 within the handle hollow interior 26 until the second shaft end 20 generally abuts the other enclosed handle end 28.

Figure 2:
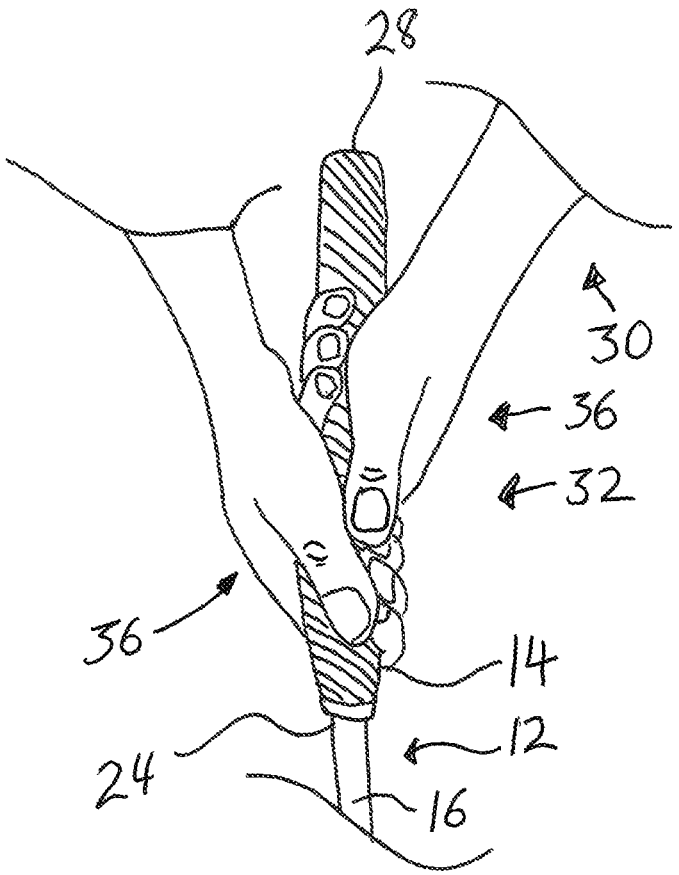
FIG. 2 is substantially an elevation view of golf club, such as a putter, being gripped by a golfer.

As substantially shown in FIG. 2, a golfer 30 could use a two-handed grip 32 to grasp the golf club 12. The lower placed or position hand 34 could grip golf club handle 14 proximate to the open handle end 24 to allow a pinkie finger of that lower-placed hand 34 to be interlocked with the first finger of the other upper placed or positioned hand 36 that grips the golf club handle 13 closer to the enclosed handle end 28. This golf club grip 32 upon the club handle 14 could provide for a significant portion of the handle's enclosed end 28 to be uncovered by the golfer's hands to further provide an exposed enclosed handle end 28 for the golf club 40 (as substantially shown in FIG. 3) tool to be attached to or incorporated within the club handle 14 without interfering with the golfer's club grip or swing.

Figure 3:
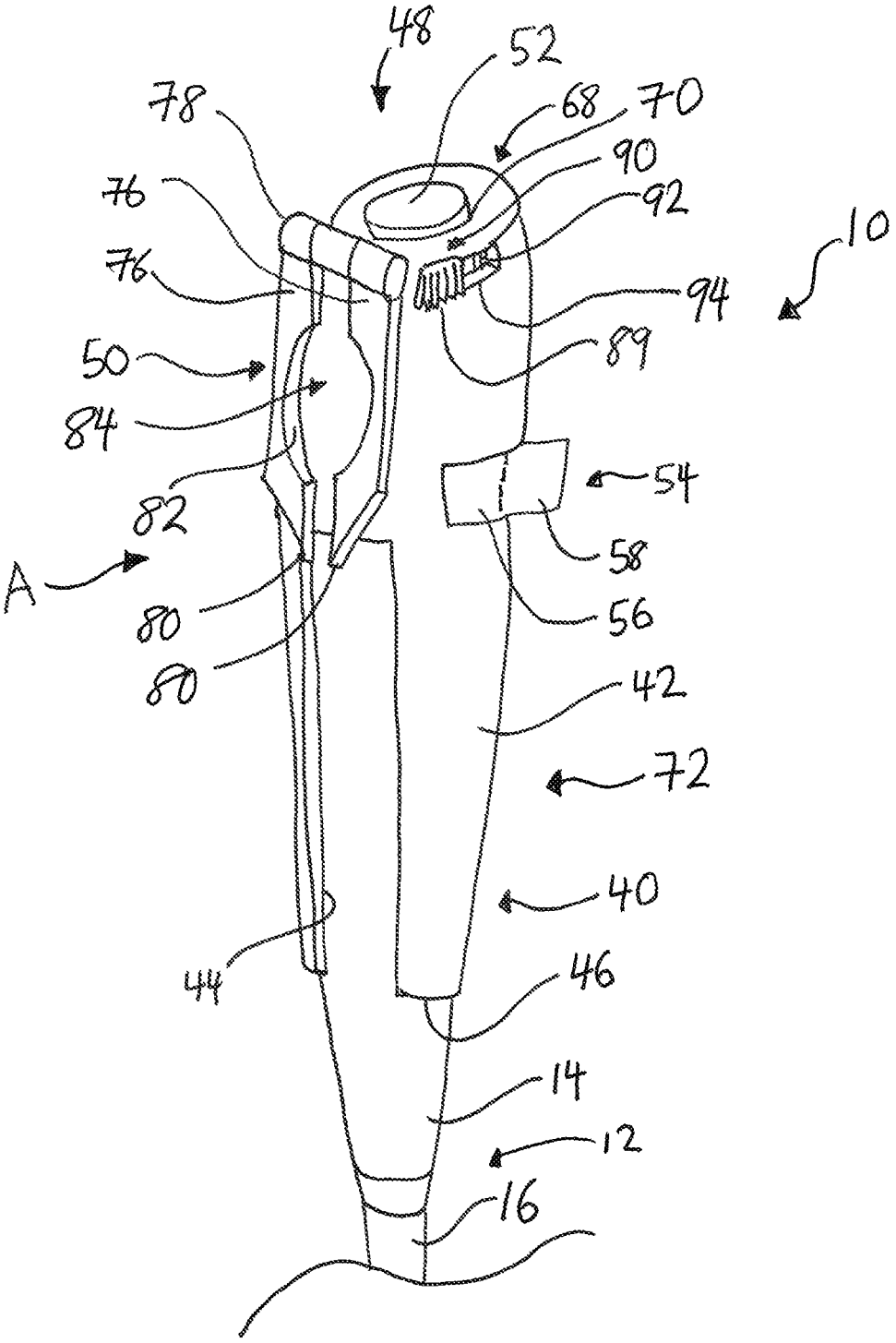
FIG. 3 is substantially a perspective view of a horizontal slide lock version of the golf tool of the present invention in the first or storage position.
Figure 4:
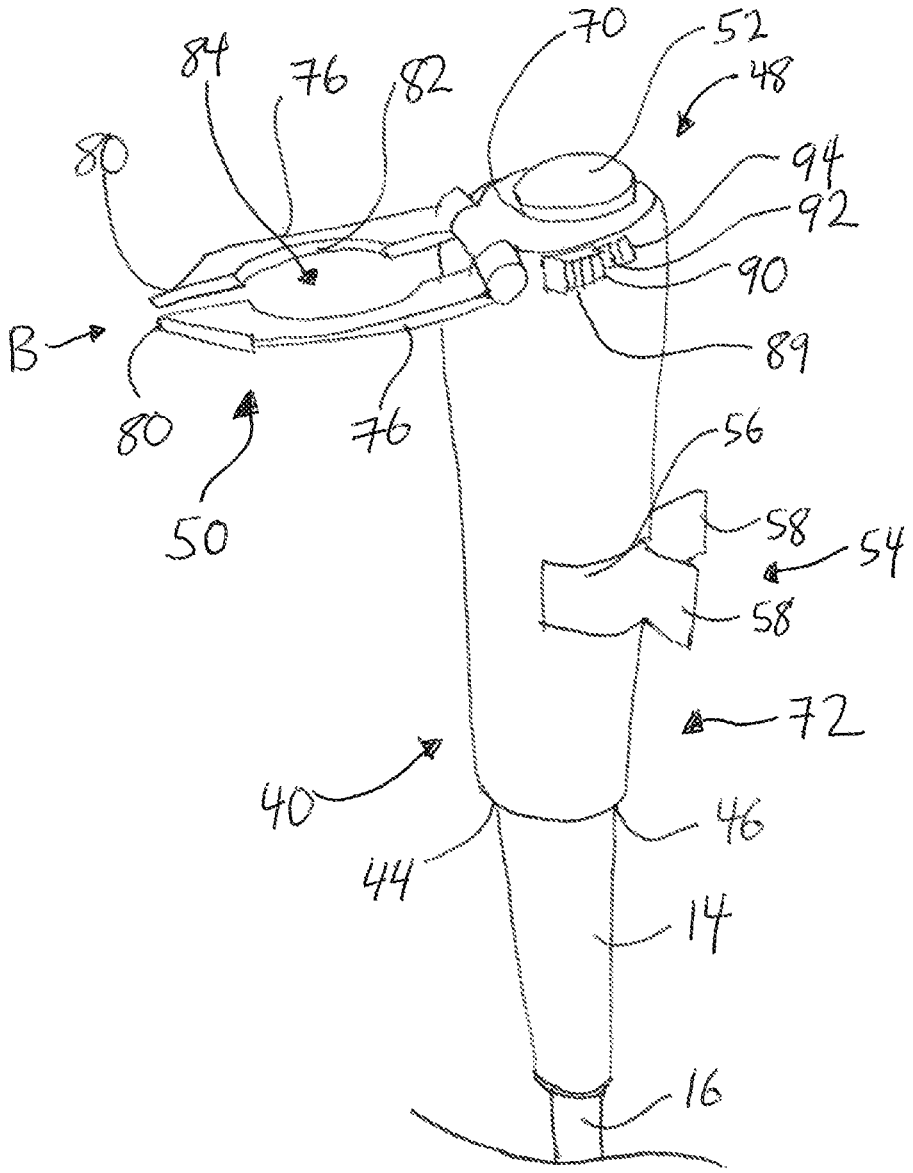
FIG. 4 is substantially a perspective view of the horizontal slide lock version of the golf tool of the present invention in the second or perpendicular operative position.
Figure 5:
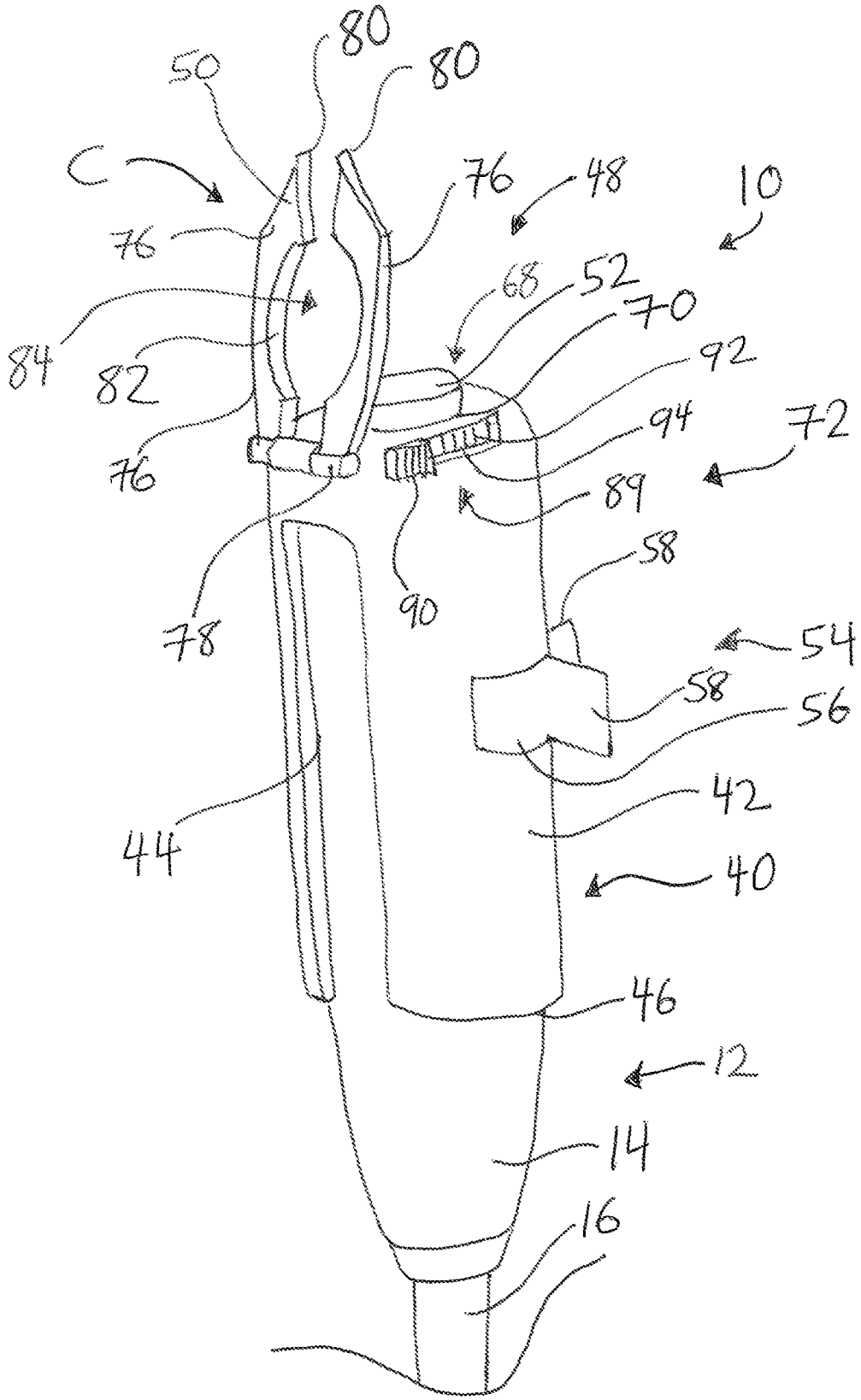
FIG. 5 is substantially a perspective view of the horizontal slide lock version of the golf tool of the present invention in the third or parallel operative position.

As substantially shown in FIGS. 3-5, the golf club tool 40 could comprise a cylindrical like tool body 42 that forms a hollow body interior 44 that continuously connects to an open body end 46 that may receive golf club handle 14. The tool body 42 may further form an enclosed body end 48 that movably supports a multi-prong fork 50 and golf ball marker apparatus 68. The tool body 42 could be made of suitable resilient polymer material that generally has a cylindrical shape.

The tool body 42 in at least one version could further comprise a golf club handle retaining device 54 comprising a C-shaped band spring 56 that could be incorporated into the tool body 42 to compress the tool body 42 and the formed hollow interior 44. This spring bias could cause the tool body 42 to removably grasp a significant portion of the golf club handle 14 as inserted into the body interior 44. The C-shaped band spring 56 could further comprise a pair of spring tabs 58, with each spring tab 58 extending outward from respective side of the C-shaped band spring 56 in open, spaced-apart relationship. These spring tabs 58, when generally squeezed together by the golfer or other operator (not shown) could substantially counteract the spring bias to spread apart C-shaped band spring 56. This spring bias counteraction could allow an increase of a circumference of the hollow interior 44 to release the retaining grip of the tool body 42 upon the golf club handle 14. As the spring tabs 58 are moved together, the golf club handle 14 could be withdrawn from the handle interior 44. The positioning of these spring tabs 58 should allow the spring tabs 58 from contacting or otherwise interfering with a golfer's grip when holding the golf club-golf tool combination 72.

Figure 5A:
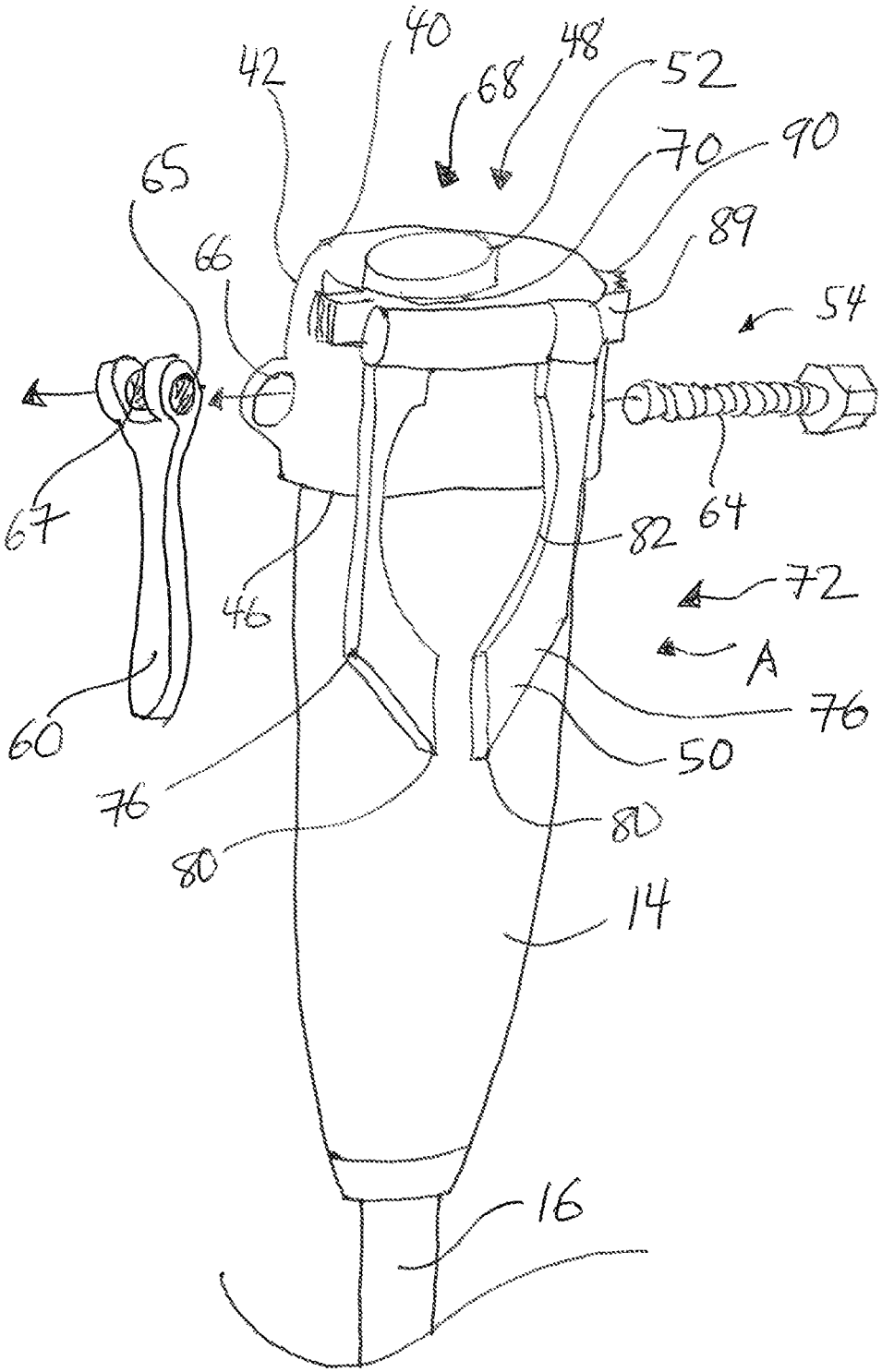
FIG. 5A is substantially a perspective exploded view of a quick release lever version for attaching the golf tool of the present invention to a golf club handle.

In another embodiment is FIG. 5A, golf club handle retaining device 54 could be quick release lever device 60 like the type used to adjust the seat height on bicycles. The quick release lever device 60 could comprise a pivoting lever 62 removable threaded upon a fastener 64 (e.g., bolt). The lever at one end could form a set of spaced-apart ears removably holding a cylindrical retaining bar 65 between the ears. The cylindrical retaining bar 65 could define a double-open ended, threaded retaining channel 67 substantially passing laterally through the cylindrical retaining bar 65. The rotatable cylindrical retaining bar 65 could further pivoting action based at the ears end of the pivoting lever 62.

The fastener 64 could movably penetrate through a width-wide portion of the tool body 42 via a double open-ended fastener channel 66. Once the free threaded fastener end has passed through the double open-ended fastener channel 66, the threaded fastener's free end can removably engage the retainer channel 67 to movably attach the pivoting lever 62 to the threaded fastener 67. When the pivoting lever 62 is then pivoted about the retaining bar-threaded fastener combination to an open position (not shown) away the tool body 42, the pivoting lever 62 can be rotated about the threaded fastener 64 (e.g., move the retaining bar 65 and hence the pivoting lever 62) along a length of the threaded portion of the fastener 64 as needed) to adjust the amount of tension that the pivoting lever can suitably impart upon the golf tool body (by the open body end 46) to make the tool body 42 removably attach to the club handle 14. When the pivoting lever 62 is set along the desire position upon the fastener length to provide an appropriate tool body tension upon the handle 14, the pivoting lever 62 can be placed in the closed position (e.g., pivoted proximate to the tool body 14.) Pivoting into the closed position should exert enough compression or constriction force upon the open body end 46 to allow the tool body 42 to properly retain the handle 14 within the hollow interior 44. Conversely, the pivoting lever 62 could be pivoted away from the tool body 42 to the unlocked position (not shown) to release the tension of the tool body 42 upon the club handle 14 to allow possible removal (or repositioning) of the golf club tool 40 relative to the club handle 14.

As substantially shown in FIGS. 5-14, The golf ball marker apparatus 68 could be located on the golf tool's enclosed body end 48 to fixedly incorporate a magnet 70 or the like that magnetically and removably engages a golf ball marker 52 placed near (e.g., over) the magnet 70. The golf ball marker 52 could be a disc containing magnetic (e.g., ferrous) material to allow a creation of removable magnetic attraction between the magnet 70 and the golf ball marker 52. In use, the golf tool's enclosed body end 48 could be brought into contact with the green, ground or the like to allow the golf tool closed body end 48/golf ball marker apparatus 68 to brush against the green, ground or the like (as substantially shown in FIG. 7.) This green interaction could overcome the magnetic force between the golf tool 40 and golf ball marker 52 to substantially deposit the golf ball marker 52 upon a desired spot in the green. After relative play (e.g., putting by an opponent) of the short game has occurred, the golf tool (via the golf club 12) could be brought into proximity with the golf ball marker 52 upon the green, ground or alike. In such a position, the magnet 70 could magnetically re-attach the golf ball marker 52 to the golfing tool 40 for the next use.

As substantially shown in FIGS. 5-14, the multi-prong fork 50 could comprise multiple prongs 76 or tines attached to (e.g., ends of) a fork axle 78. In one version, the prongs 76 could be presented in parallel and spaced-apart orientation to one another. Each prong 76 could have a tapered or pointed prong end 80 while the other prong end substantially attaches to the axle (e.g., at a respective axle end). The fork axle 78 could be movably attached to an edge of the enclosed body end 48 to allow the multi-prong fork 50 to pivot relative to the tool body 42. In one version of the invention, the prongs or tines 76 could have scalloped inner prong edges 82. The curved or scalloped inner prong edges 82 could face one another in a spaced-apart manner to substantially create an opening or ball groove 84 that may accommodate the curvature of a golf ball 38 as supported by the multi-prong fork 50 (as substantially shown in FIG. 7.)

In one possible embodiment not shown, each prong 76 could further be movably (e.g., pivotally) mounted to the fork axle 78 and be spring (e.g., coil spring) biased (not shown) to move towards each other (e.g., the pointed prong ends 80 could be biased to move closer together.) In golf ball retrieval operations (not shown), the golf tool-golf club combination 72 (not shown) could be manipulated by the golfer so that pointed prong ends could be directed to and pushed down upon a golf ball resting upon the ground (e.g., a green or within the green's hole) in a manner that otherwise forces prongs to move against spring bias and move the point prong tips apart from one another. This prong movement could allow the prongs to slip around the sides of the golf ball until the golf ball is removably engaged by or cradled between the prongs' scalloped interior edges. The prongs, so removably holding the golf ball, could allow a subsequent golfer manipulation of the golf tool-golf ball combination to provide a removal of the golf ball from the green, green hole, ground or other surface.

As substantially shown in FIGS. 3, 4 and 5, the multi-prong fork 50 could be further defined to have the capacity to be pivot between three set stations or positions relative to the golf tool body. One such station could be a first or storage position A with the multi-prong fork 50 being pivoted and positioned generally flat or flush against the tool body 42 (e.g., generally parallel to the golf club shaft 16). A second station could be a perpendicular operating position B wherein the multi-prong fork 50 is pivoted to project outward from and perpendicular to the golf tool body 40 (e.g., the golf club shaft 16) to allow the golf ball to be scooped up and to come to rest upon the top of the prongs 76 as substantially shown in FIG. 7. In this manner, the golf club and tool combination 72 could present the prongs 76 parallel to the green to scoop under and lift a golf ball from the green. Conversely, the golf tool-golf club combination 72 could be also used to place the golf ball upon the green or ground as well. This second operating position B could be seen as being less useful in extracting the golf ball from the green hole (e.g., such a sidewise presentation of the multi-prong fork may not allow the multi-prong fork to enter the cup in a manner to move under the golf ball.)

The third or parallel operating position or station C could place the multi-prong fork 50 in outward orientation parallel to the tool body 42 (e.g., golf club shaft's central lengthwise axis) to give the golf tool-golf club combination 72 a spear-like appearance. In this manner (not shown), the golf ball on the green, on the ground or in the green cup and alike could be speared by the golf tool-golf club combination 72. The prongs 76 could meet and then be spread apart a moving contact with the golf ball until the golf ball is significantly held within the ball groove 84 by the prongs scalloped edges pressing against the opposing sides of the golf ball. The multi-prong fork 50 could removably hold the golf ball between the biased prongs 76 until the operator generally removes the golf ball from the golf tool-golf club combination 72. This position C could provide golf ball removal from the ground, green, green hole and alike.

This position C could also possible be used to place the golf ball upon the green or ground or alike as well (not shown.) The golfer could use the edges of the golfer's shoes to removably hold the golf ball on the desired place (such as replacing the golf ball on the green after retrieving the golf ball maker) while retracting the golf tool-golf club combination from the ball.

The multi-prong fork's pivoting action could be facilitated by a tool body mounted detent engagement mechanism 86 to generally hold the multi-prong fork orientation in place at particular position or station (A, B, or C) until the golfer (not shown) moves the multi-prong fork 50 to a different station. The detent engagement mechanism 86 could comprise a set of three space-apart indentations 79 (each indentation 79 is associated with a respective multi-prong fork position A, B, or C.) The indentations 79 could be placed about the fork axle's middle circumference and a biased pin 88 that removably engages the respective indentation to hold the multi-prong fork at a desired station. In one version, as substantially shown in FIGS. 3-5 and 6-7, could be a horizontal slide lock 89 wherein the pin 88 could be connect perpendicularly and outwardly from a middle of a rectangular bar 90 substantially and movably held in a block channel 91 as defined by the enclosed body end 48. The two bar ends of the rectangular bar 90 could remain exposed or otherwise protrude out from the sides of the enclosed body end 48 to allow for operator manipulation of the rectangular bar 90. A flat, zigzag, magazine-type spring 92 could be placed on the other side of the rectangular bar 90 (e.g., opposite of the side from which the pin 88 protrudes) and could be held movably captive within a spring channel 94 as also formed by the enclosed body end 48. The zigzag spring 92 could constantly contact and further bias the rectangular bar and pin combination towards the fork axle 78 to otherwise removably engage the pin 88 with a respective indentation 79 to hold the multi-prong fork 50 at the desired station or position (e.g., A, B or C.) In this manner, the operator could grasp the rectangular bar edges to move the rectangular bar 90 back against the zigzag spring 92, and to move the pin 88 away and out of contact from a respective indentation 79. This action could allow for a rotation of the multi-prong fork 50 into another desired station A, B, C).

Figure 6:
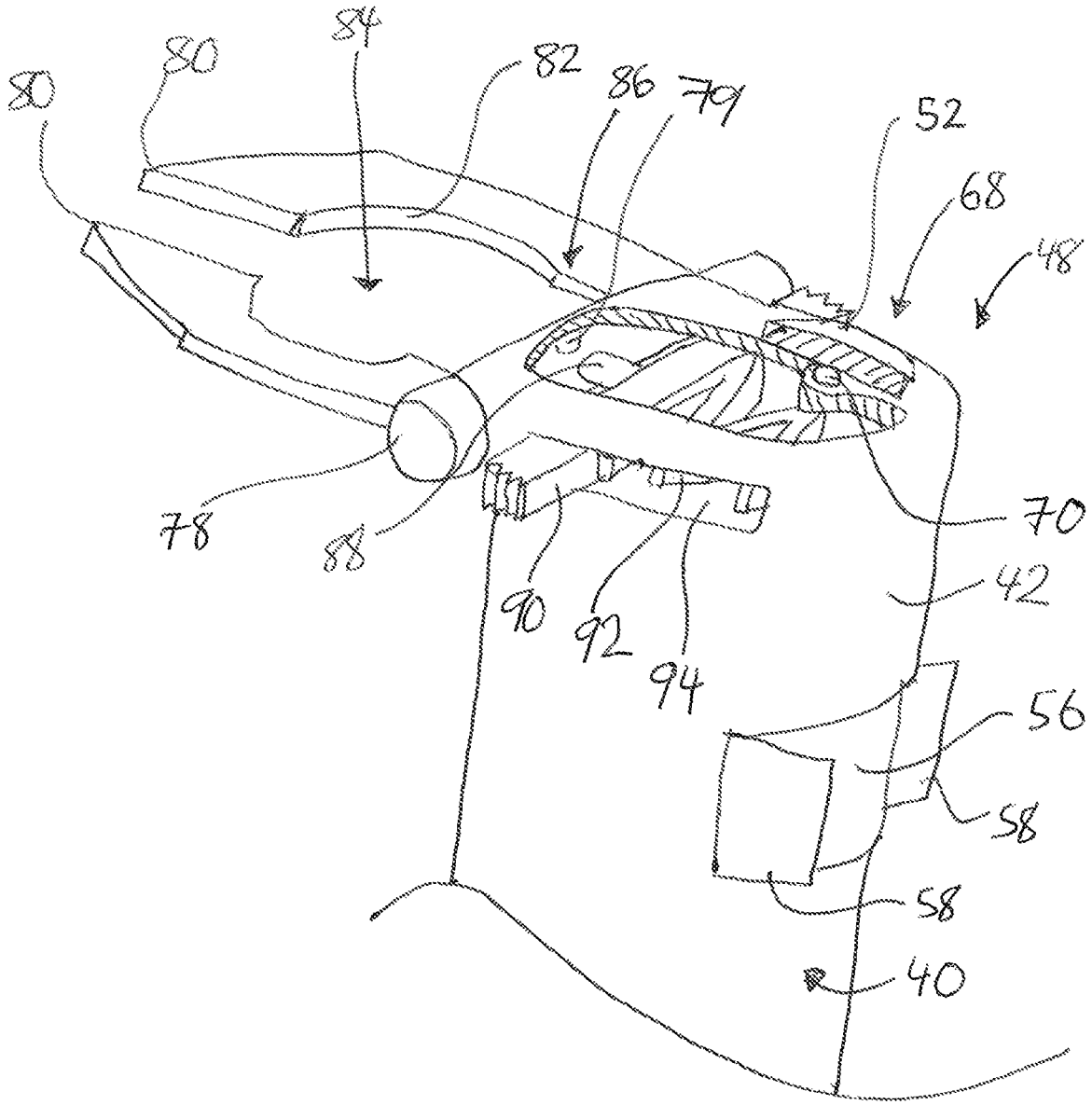
FIG. 6 is substantially a perspective top cutaway view of a horizontal slide lock version of the golf tool of the present invention in the second or perpendicular operative position.
Figure 6A:
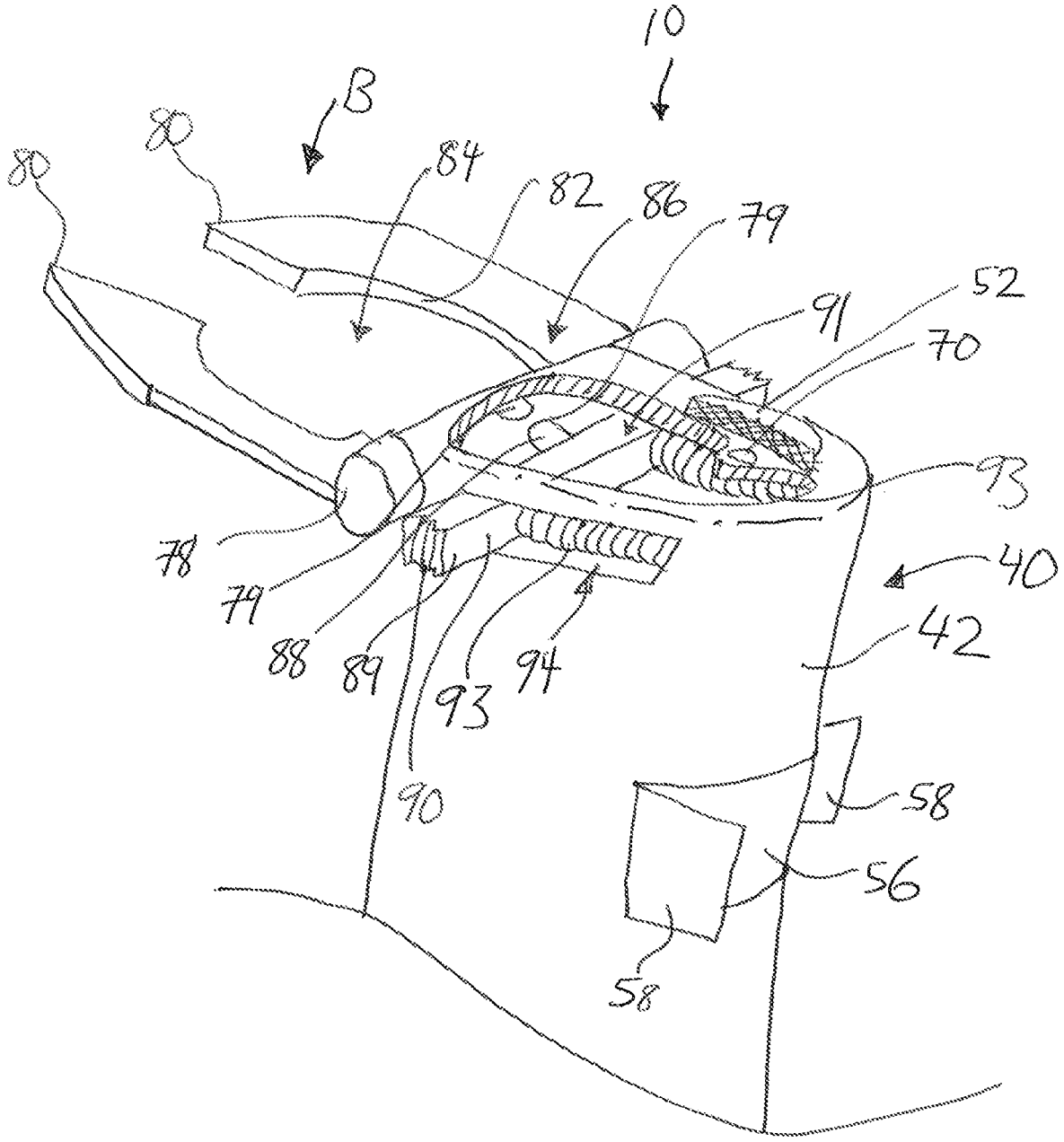
FIG. 6A is substantially a perspective view of another embodiment of the side mounted slide lock version of golf tool-using multiple helical springs for biasing the slide lock.
Figure 7:
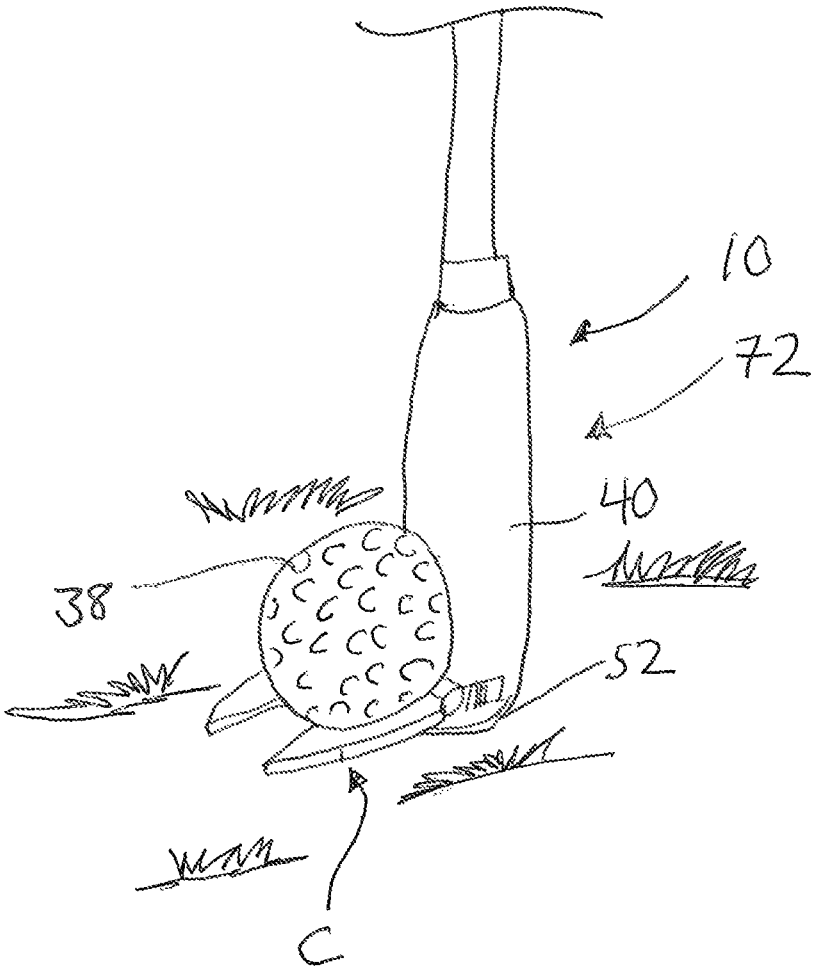
FIG. 7 is substantially a perspective view of a horizontal slide lock version of the golf tool-golf ball combination of the present invention set in the second or perpendicular operative position to scoop up a golf ball.
Figure 8:
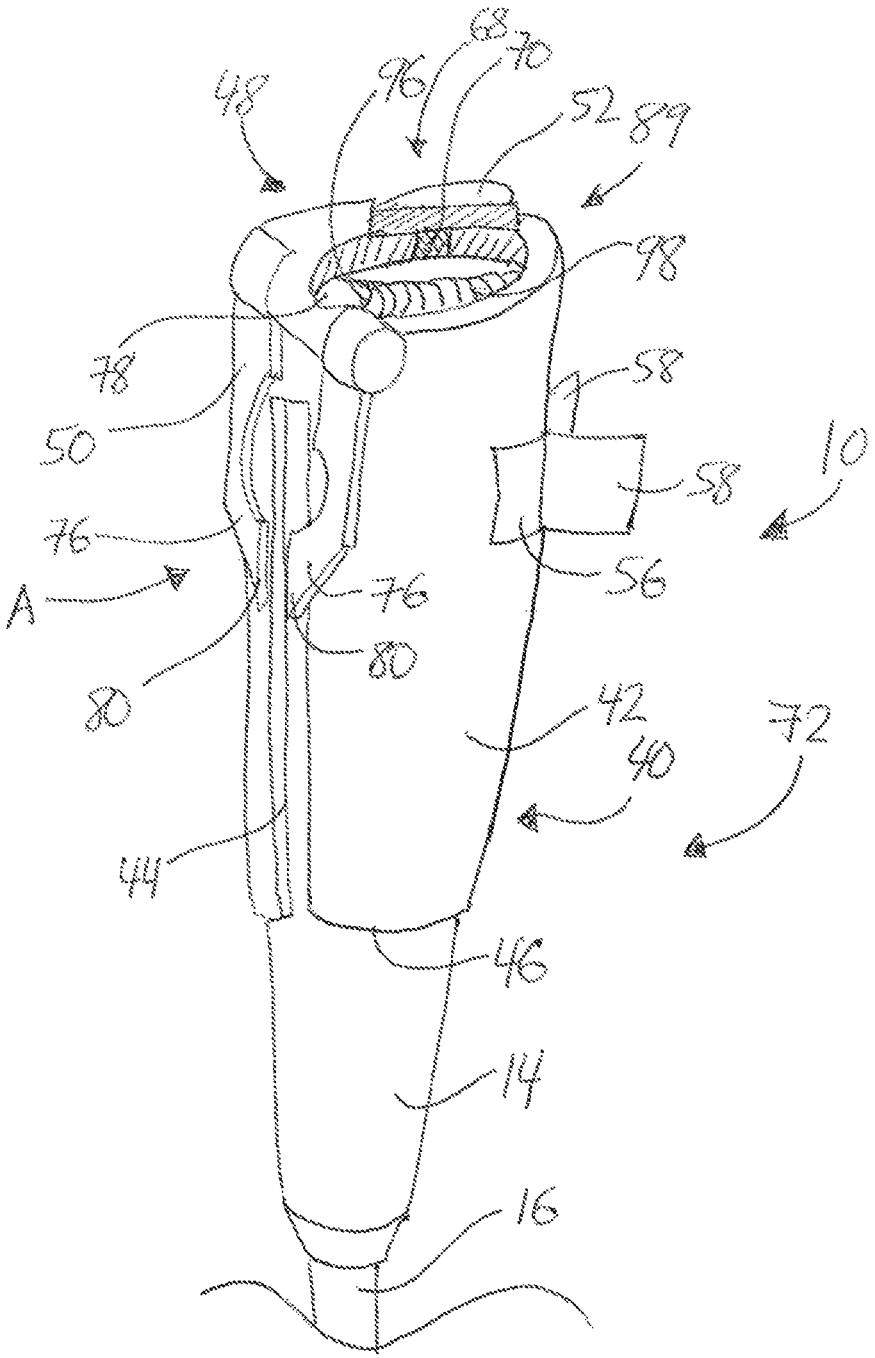
FIG. 8 is substantially a perspective cutaway view of a horizontal ball detent version of the golf tool-golf ball combination of the present invention set in the first or storage operative position.
Figure 9:
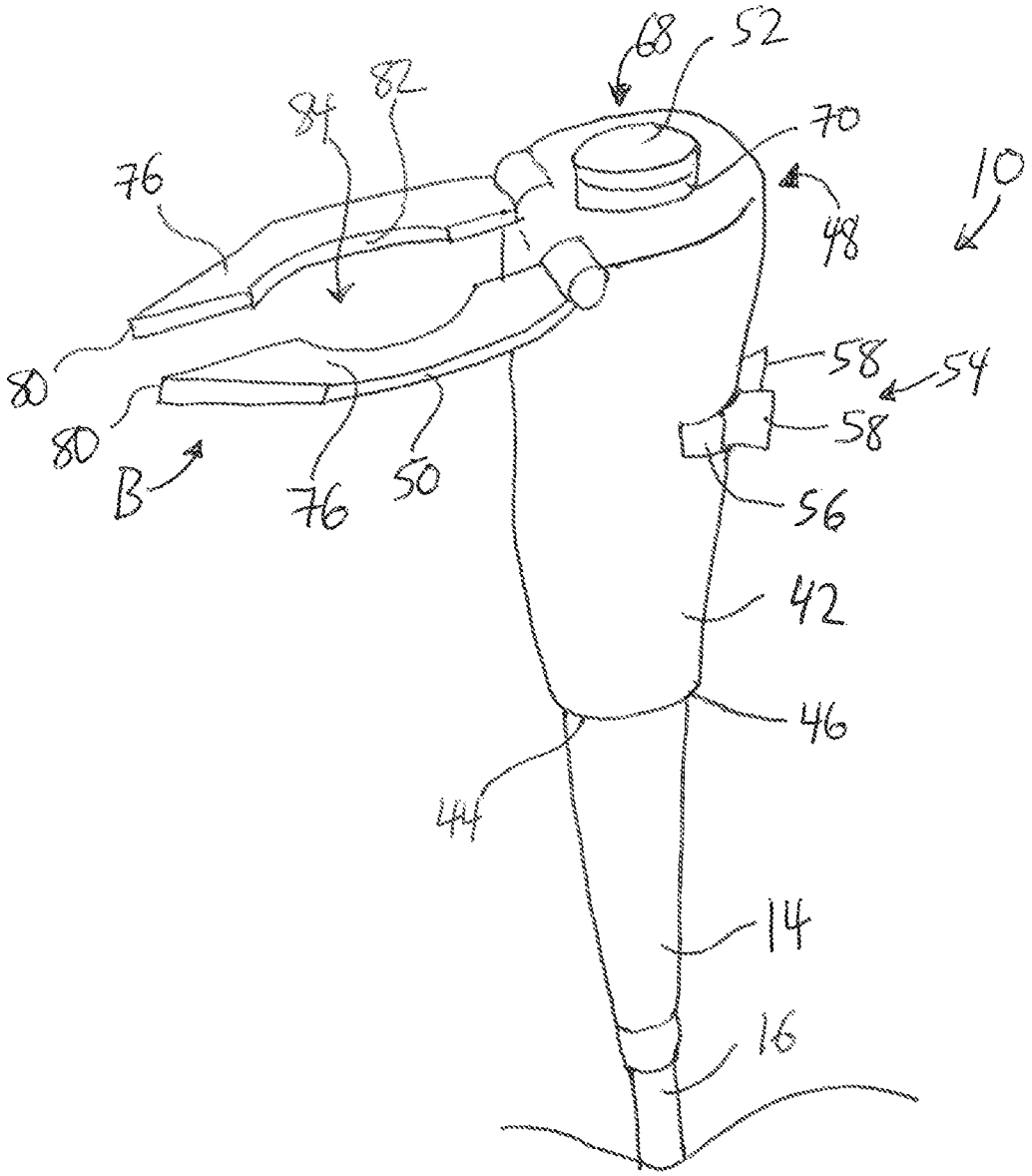
FIG. 9 is substantially a perspective view of the horizontal ball detent lock version of golf tool of the present invention set in the second or perpendicular operative position.
Figure 10:
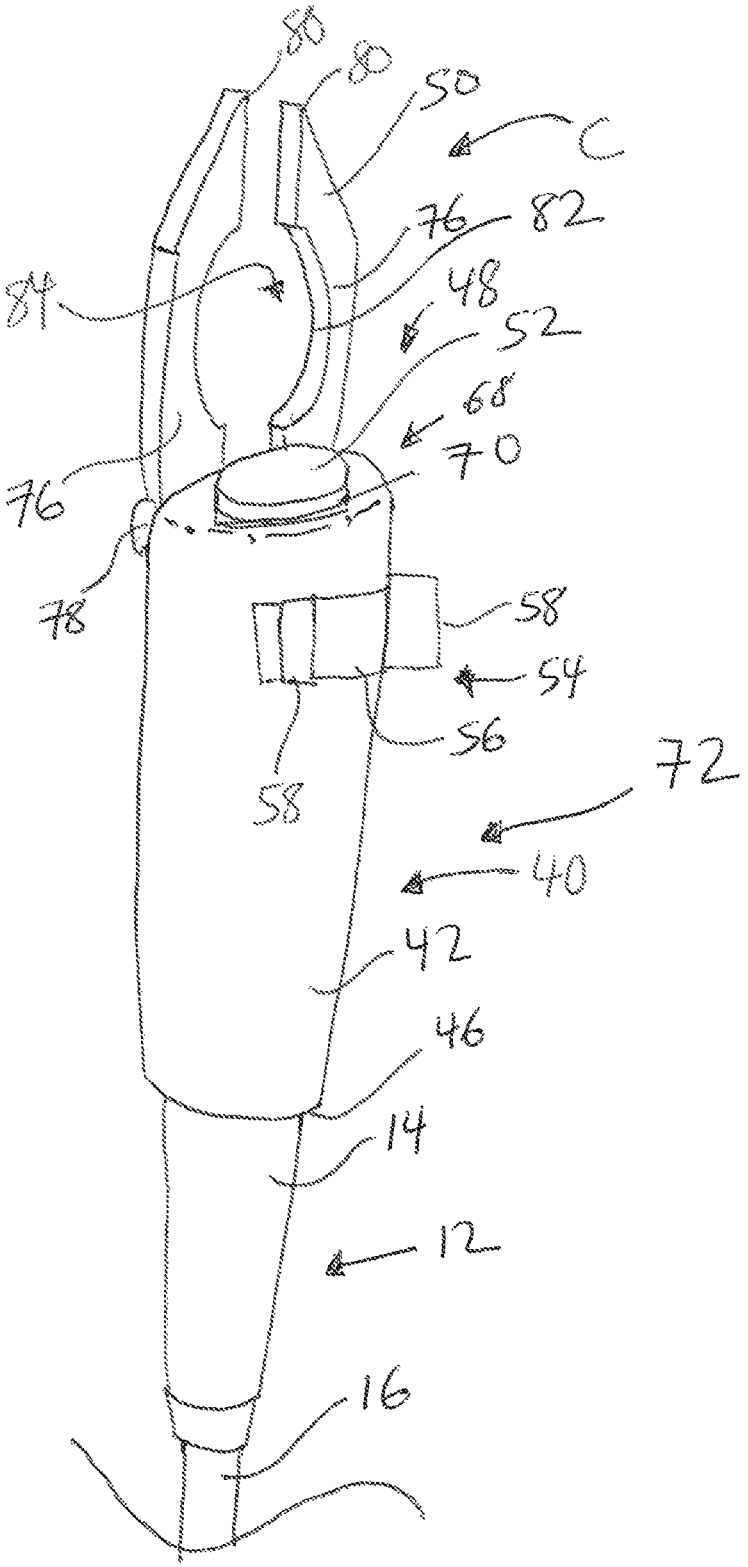
FIG. 10 is substantially a perspective view of the horizontal slide ball detent lock version for golf tool of the present invention set in the third or parallel operative position.
Figure 11:
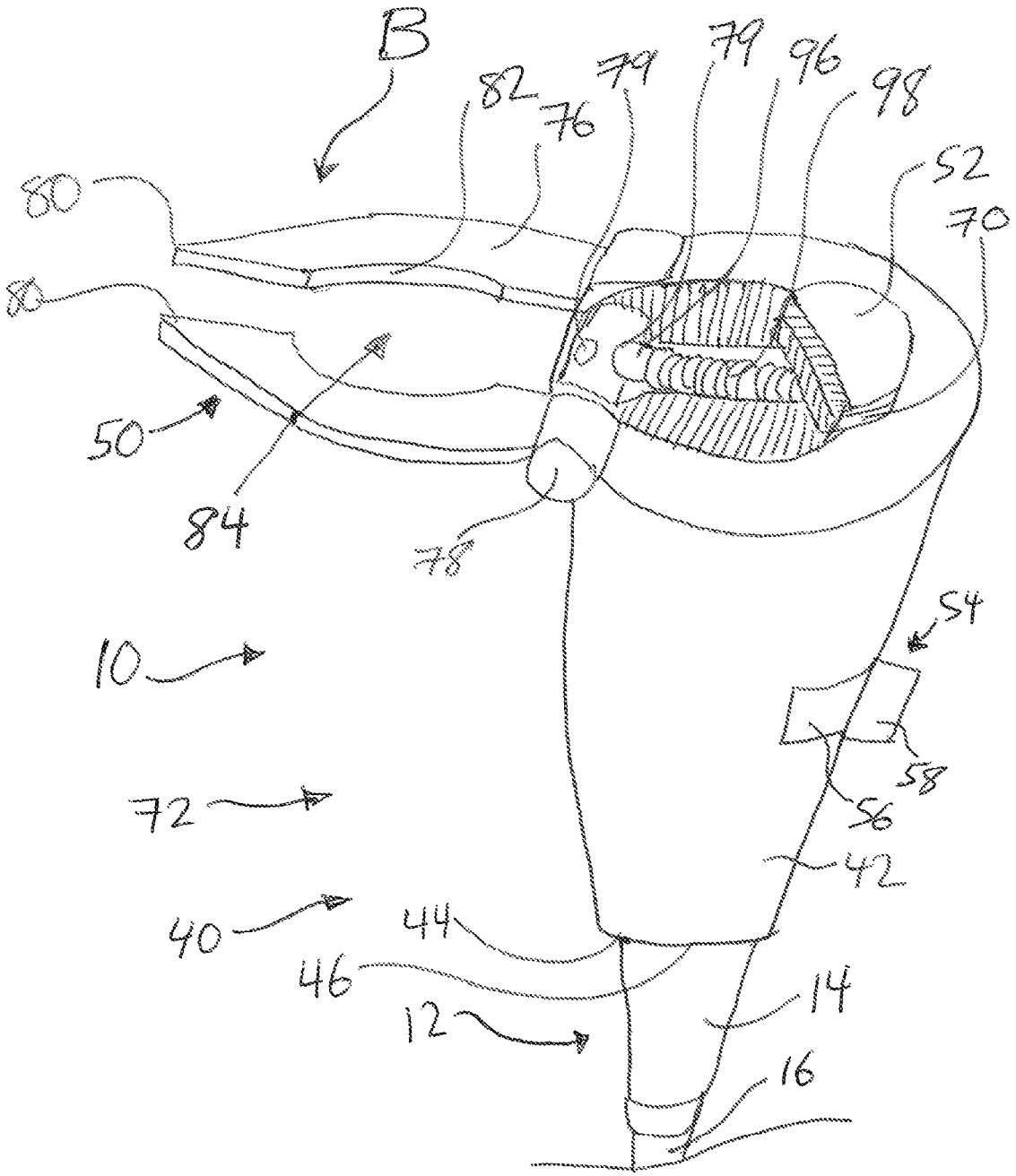
FIG. 11 is substantially a perspective cutaway view of the horizontal slide ball detent lock version of golf tool of the present invention in the third or parallel operative position.

In another embodiment, as substantially shown in FIG. 6A, the zigzag spring 92 could be replaced by a set of helical springs 93. The set of helical spring 93 could be located on the back side of the rectangular bar 90. There could be one helical spring 93 located proximate to a respective rectangular bar edge. A projection generally emanating outward from the rectangular bar backside proximate to each rectangular bar edge could further facilitate holding a respecting helical spring in place in relation to the rectangular backside.

As substantially shown in FIGS. 8-11, another version of horizontal slide lock 89 could comprise a ball 96 or rounded end pin (not shown) that could be movably held within the enclosed body end 48 and be biased by spring (e.g., coiled) 98 to interact with axle indentations 79. The engagement portions of the pin (not shown) or ball 96 and the axle indentations 79 could be mutually shaped (e.g., having a hemispherical shape) and of such limited depth to allow axial torsional or rotational force (e.g., as applied by the golfer or operator) to overcome that ball/indentation interaction. This action could allow for fork axle rotation to move the multi-prong fork 50 from one station to another station.

Figure 12:
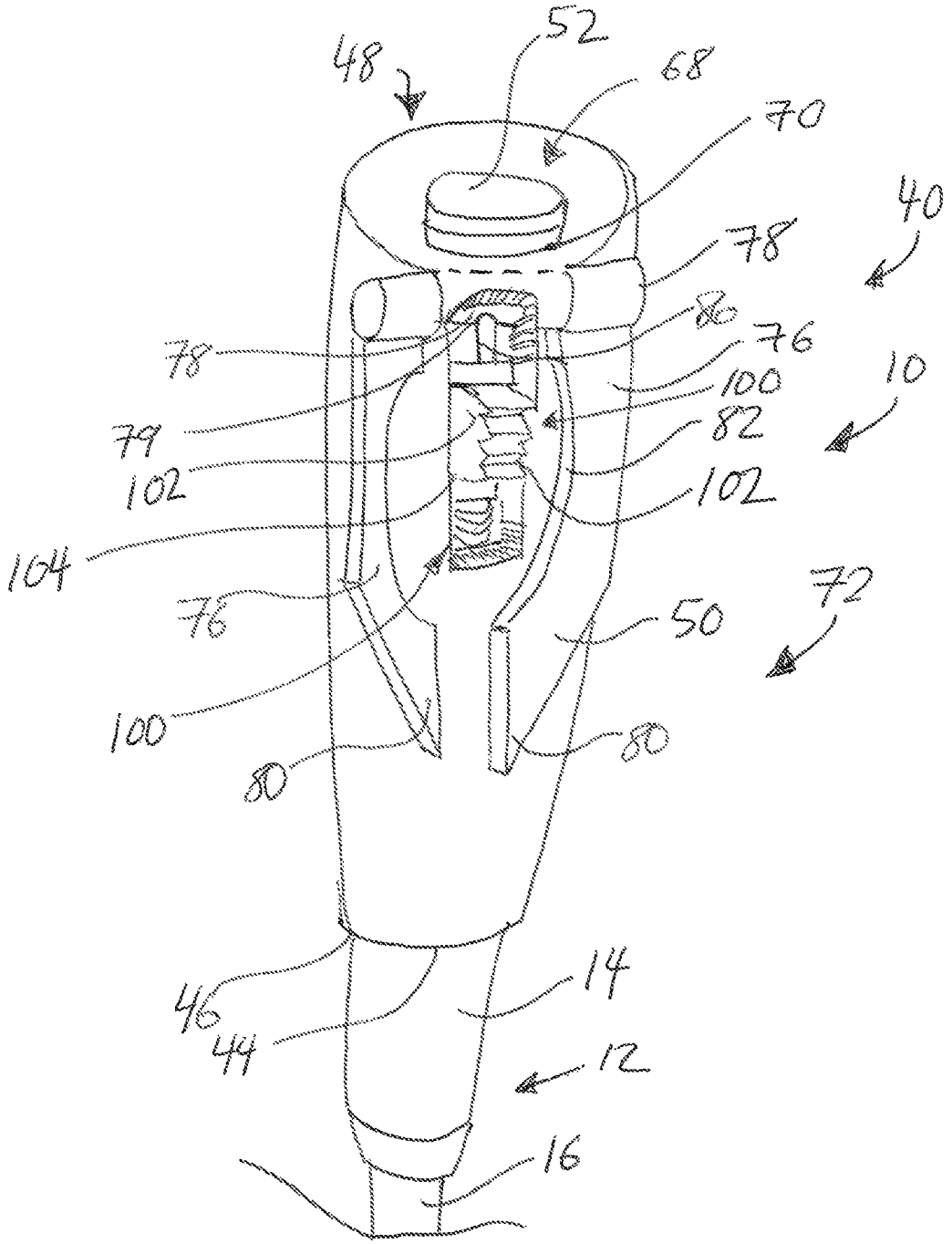
FIG. 12 is substantially a perspective cutaway view of a vertical slide lock version of golf tool-golf ball combination of the present invention in the first or storage operative position.
Figure 13:
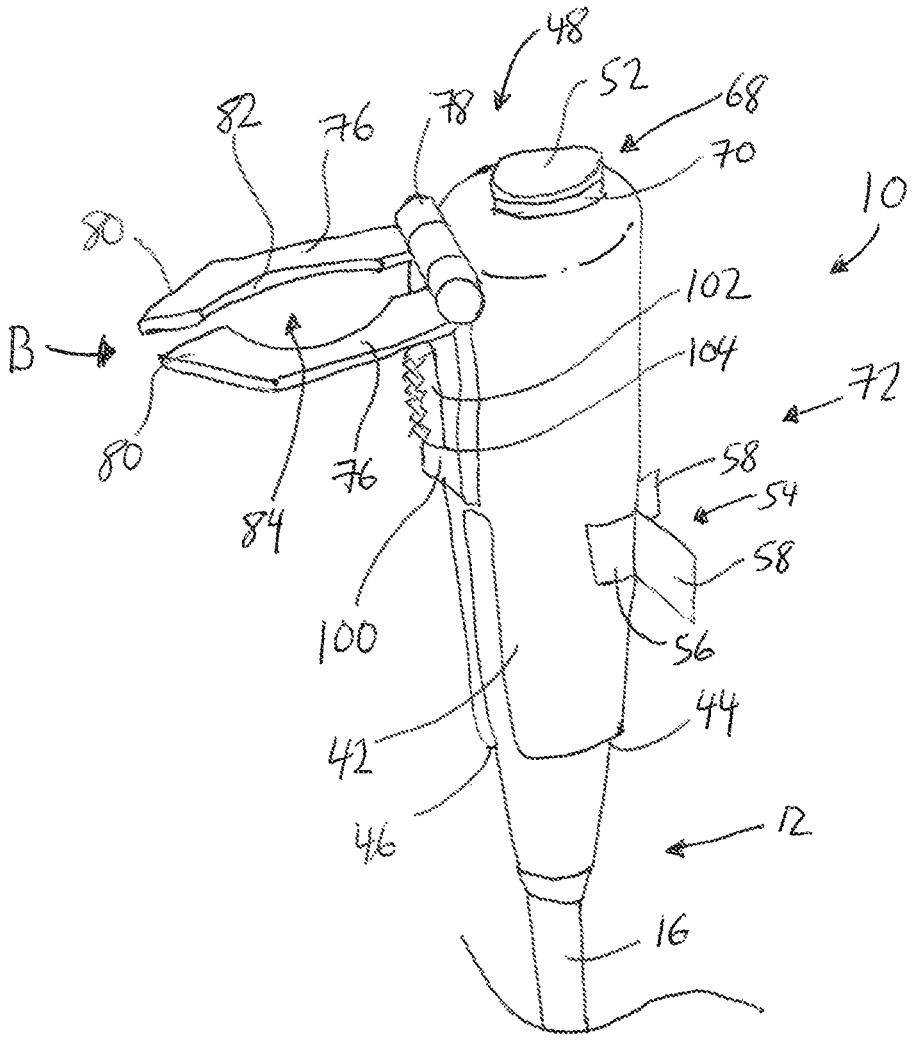
FIG. 13 is substantially a perspective view of the vertical slide lock version of golf tool-golf ball combination of the present invention in the second or perpendicular operative position.
Figure 14:
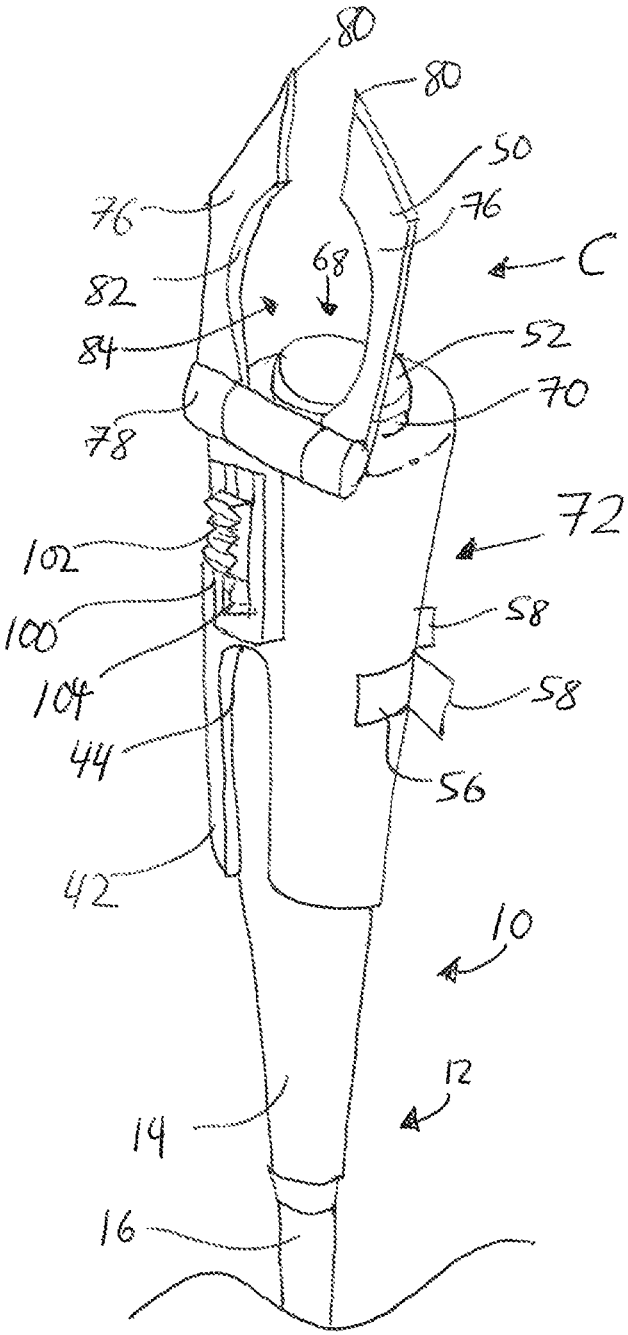
FIG. 14 is substantially a perspective view of the side mounted slide lock version of golf tool-golf ball combination of the present invention in the third or parallel operative position.

As substantially shown in FIGS. 12-14, another version of the detent engagement mechanism 86 could be a vertically mounted slide lock 100 on the side of the tool body 42, underneath the fork axle mounting. The vertically mounted slide lock 100 could comprise a pin-block combination 102 movably retained within an open block channel 104 as formed by the tool body 42. The one block end could support an outwardly protruding pin (not shown) while the other block end could contact a coil spring (not shown) that is also movably held captive within the open block channel 104. In this manner, the pin of the pin-block combination 102 may spring biased to movably engage the axle indentations (not shown.) A top of the block may protrude through an open block channel 104 to substantially allow operator manipulation or operation of the said vertical slide lock 100.

Another possible embodiment of the invention (not shown) could be a golf tool body to act as the gold handle. The tool body being generally cylindrical in shape with one open end connecting a hollow body interior to the tool body exterior through an open body end. The open body end could receive an $2^{nd}$ shaft end within the hollow body interior. The tool body could be made of resilient material such an appropriate polymer that could initially have a smaller hollow interior circumference that could be expanded by the larger shaft circumference to allow the golf tool body to grip and hold onto the inserted golf club shaft. The other enclosed end of the golf tool body could support a magnet that removably holds the magnetic golf ball marker as well as pivotally attach to the axle of the multi-prong fork. The golf tool body could further support a detent locking mechanism for controlling the rotation of the axle and positioning of the multi-prong fork in proper orientation.

Process or Method of Operation

As substantially shown in FIG. 15, the method or process of operation 200 could start with the step 202, deciding what tool use to implement. In this step, the operator or golfer could before golfing could have removably placed and secured the golf tool to the handle of golf club such as a putter to create a golf tool-golf club combination. In another embodiment, the golf club can have been made with the golf tool with the tool body acting as the golf club handle or subsequently modifying the golf club to remove its original handle and replacing the original club handle with the golf tool whose tool body acts as the golf club handle.

During play of the game, the golfer could have played the golf ball upon the respective green and has reached for the putter-golf tool combination (or if the handle body directly incorporates the golf tool just the golf club itself) from the golf bag. The golfer then decides what golf tool task to address with the putter-golf tool combination. After this step has been substantially completed, the process or method 202 could proceed to step 204, activating the golf tool.

In step 204, activating golf tool, the golfer then activates either the golf ball marker or the multi-prong fork portions of the golf tool. In activating the golf ball marker, the golfer could removably place or otherwise adjust the magnetic disk golf ball marker relative to the magnet held by the golf tool body.

In activating the multi-prong fork, the golfer could first move the associated spring lock out of engagement with the respective fork axle indentation allowing axle rotation. In another version, the golfer just applies torsional force to the fork axle (e.g., force rotates the prongs) to move the respective spring biased pin or ball out of engagement with a respective axle indentation. In either manner, the prongs can be moved or rotated out of the first storage position to the first (e.g., perpendicular) operational position or second (parallel or spear-like) operation position. Once this step is substantially completed, the process 200 can proceed onto step 206, using the golf tool.

In step 206, using the golf tool, the golfer, in repairing a green divot (e.g., from the golf ball being driven onto and denting the green), the prongs could be oriented into parallel operation position. The golfer could the grasp the golf club held by the club head to spear the multi-prong fork into the divot indentation and gently lift the grass and soil to remove the indentation, eliminating the divot impression.

The golfer in picking up the golf ball, could first manipulate the golf tool-golf club combination where in the multi-prong fork rotated into position either to slide under (or spear the golf ball.) The golfer could the grasp the golf club held by the club head bring the golf tool proximate to the lain golf ball. The golfer then either spears then the golf tool-golf club combination (e.g., the multi-prong fork) onto the golf ball (e.g., as held within the green's cup) or slides the multi-prong fork underneath the golf ball. The golfer then manipulates the golf tool-golf club combination to lift the golf ball from the ground, green, green cup or the like. The golfer then removes the golf ball from the multi-prong fork.

In placing the golf ball marker where the golf ball has come to rest, the golfer could first move the multi-prong fork towards either perpendicular operating position that allows the multi-prong fork to slide under (e.g., perpendicular orientation) or spear (e.g., parallel orientation) the golf ball to remove the golf ball from the green, green cup, ground or the like.

If the prong fork is placed in the perpendicular operating position during this golf ball removal operation and the golfer is nimble enough, the magnetic ball marker could also be brought into contact with the ground, green or the like through a swinging motion. Such ball marker contact could occur as the multiple prong fork is brought underneath the resting golf ball with a swinging motion. This contact should allow golf ball removal as well as enable the golf ball marker to break contact with the golf tool magnet and remain on the ground, green or alike in place of the retrieved golf ball. The golfer could then further manipulate the club-tool combination so the golfer's free hand could be used to reach and remove golf ball from the multi-prong fork.

If the golfer is not that nimble, after the golf ball could be first be removed with the multi-prong fork (as described above.) After the ball has been removed from the multi-prong fork, the multi-prong fork could be rotated back to the storage position (e.g., deactivate the detent locking mechanism; rotate the fork axle vis-à-vis prongs accordingly; and release the detent locking mechanism to removably hold the multi-prong fork in place in the storage position). The golfer or other operator (e.g., a caddy) could grasp the golf club by the club head and maneuver the golf tool enclosed end to contact the green or other ground by imparting a swiping movement to the combination. The golf tool enclosed end could place the golfer ball marker into contact with the green or other ground to move the golf ball marker away from the magnet and leaving the marker in the green position where the removed golf ball had formerly lain.

After the other golfer(s) have played through that portion of green demarked by the golf ball marker, the golfer could then bring the enclosed body end proximate to the golf ball marker to allow the magnet to removably engage the golf ball marker for the removal of the golf ball marker from the green or other ground.

After this step is substantially completed, the process 200 could proceed to step 208, resetting the golf tool.

In step 208, resetting the golf tool, after the need for the golf tool on the green, green cup, ground or like has passed, golfer could place multi-prong fork into the respective storage position. The golf tool-club combination could then be placed back into the golf bag as needed. The process 200 could then proceed back to step 202.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A golf club tool comprising: (A) a tool body defining a hollow body interior that continuously connects an open first body end to an enclosed second body end; (B) the hollow body interior further configured to removably receive and partially encapsulate a top portion of a golf club; and (C), an enclosed second body end removably attaches to a golf ball marker and pivotally attaches to a multi-prong fork; the multi-prong fork is further configured to have removable engagement with a golf ball, the multi-prong fork further moves between a storage position, wherein the multi-prong fork is laid against the tool body and perpendicular to the enclosed second body, a first operating position, wherein the multi-prong fork projects outward and parallel from enclosed second body end and perpendicular to the tool body, and a second operating position, wherein the multi-prong fork projects outward and perpendicularly from enclosed second body end and parallel to the tool body, wherein the first operating position allows the golf ball marker to come into movable contact with a ground to remove the golf ball marker from the top of the enclosed second body end.

2. The golf club tool of claim 1 wherein the enclosed second body end further comprises a rotational lever-based compression device that removably holds a top portion of a golf club within the hollow body interior.

3. The golf club tool of claim 2 wherein the rotational lever-based compression device comprises a rotational lever and a threaded fastener, the rotational lever at one lever end pivotally holds a cylinder having a threaded aperture that penetrates through the cylinder's width, the threaded aperture rotatably engages a portion of the threaded fastener that passes through a double open-ended channel formed by the enclosed second body end.

4. The golf club tool of claim 1 wherein the enclosed second body end further comprises a curved spring band compression device that removably holds a top portion of a golf club within the hollow body interior, the curved spring band compression device further comprises a pair of outwardly projected spaced-apart spring tabs used to release the top portion of the golf club from the hollow body interior.

5. The golf club tool of claim 1 wherein the multi-prongs of the multi-prong fork are spring-biased to move their multi-prongs' pointed ends closer together.

6. The golf club tool of claim 1 wherein the multi-prong fork is sized for placement within a green cup, the multi-prong fork's multi-prongs further having inner edges with scalloped sections configured to engage a golf ball as placed within the green cup.

7. The golf club tool of claim 1 wherein enclosed second body end further comprises a magnet that removably attaches a golf ball marker to the enclosed second body end, the magnet being configured to allow the golf ball marker to be released from the enclosed second body end when the enclosed second body end is brought, into contact with the ground.

8. A method of operating a golf club tool comprising the following steps, but not necessarily in the order shown: (A) providing a golf club tool comprising a tool body defining a hollow body interior that continuously connects to an open first body end to an enclosed second body end, the hollow body interior removably receives and partially encapsulates a top portion of a golf club; the enclosed second body end removably attaches to a golf ball marker placed on top of the enclosed second body end and further pivotally supports a multi-prong fork; the multi-prong fork is further configured to have a removable engagement with a golf ball, the multi-prong fork further moves between a storage position, wherein the multi-prong fork is laid against the tool body and perpendicular to the enclosed second body, a first operating position, wherein the multi-prong fork projects outward and parallel from enclosed second body end and perpendicular to the tool body, and a second operating position, wherein the multi-prong fork projects outward and perpendicularly from enclosed second body end and parallel to the tool body, wherein the first operating position allows the golf ball marker to come into movable contact with a ground to remove the golf ball marker from the enclosed second body end; (B) providing the golf club comprising a golf club head, a golf club shaft having a first shaft end and a second shaft end, and a golf club handle, wherein the golf club head attaches to the first shaft end while golf club handle encompasses the second shaft end to denote the top portion of the golf club; (C) removably inserting the top portion of the golf club within the hollow body interior to form a golf tool-golf club combination; (D) pivoting the multi-prong fork; and (E) removably engaging the golf ball with the multi-prong fork.

9. The method of claim 8 wherein the removably engaging the golf ball further comprising a step of moving the multi-prong fork's multi-prongs apart from one another for placing the golf ball between the multi-prong fork's multi-prongs.

10. The method of claim 8 wherein the removably engaging a golf ball further comprises a step of cupping a portion of the golf ball between scalloped portions of the multi-prong fork's multi-prongs' inner edges.

11. The method of claim 8 wherein the pivoting of the multi-prong fork further comprises a step of moving the multi-prong fork between a storage position placing the multi-prong fork against the tool body, an outward perpendicular position relative to the tool body that is configured for delivering or retrieving of a golf ball upon the ground, and an outward parallel position relative to the tool body configured for retrieving a golf ball located within a putting cup or for fixing a divot.

12. The method of claim 8 further comprising a step of grasping a golf club head of the golf club tool-golf club combination.

13. The method of claim 12 wherein the step of grasping a golf club head further comprises DIA a step placing enclosed second body end proximate to the ground.

14. The method of claim 8 wherein the removably engaging a golf ball with the multi-prong fork simultaneously comprises a step of placing the golf ball marker upon the ground by swiping a combination of the enclosed second body end and golf ball marker upon the ground.

15. A golf club-golf club tool combination comprising: (A) the golf tool having a tool body that forms a hollow interior that connects a first open body end with a second enclosed body end, the second enclosed body end comprises a removably attached golf ball marker, a pivotally attached multi-prong fork, and a compression retention device for removably holding a portion of a golf club handle within the hollow body interior; the multi-prong fork further moves between a storage position, wherein the multi-prong fork is laid against the tool body and perpendicular to the second enclosed body end, a first operating position, wherein the multi-prong fork projects outward and parallel from the second enclosed body end and perpendicular to the tool body, and a second operating position, wherein the multi-prong fork projects outward and perpendicularly from the second enclosed body end and parallel to the tool body, wherein the first operating position allows the golf ball marker to come into movable contact with a ground to remove the golf ball marker from the second enclosed body end; (B) the golf club comprising a golf head, a golf club shaft having a first shaft end and a second shaft end, and a golf club handle, the golf club head attaches to the first shaft end while golf club handle encompasses the second shaft end; wherein the hollow interior removably receives at least of a portion of the golf club handle.

16. The golf club tool-golf club combination of claim 15 wherein the compression device is a rotational lever-based compression device that removably holds a top portion of a golf club within the hollow body interior.

17. The golf club tool-golf club combination of claim 16 wherein the rotational lever-based compression device further comprises a lever and a threaded fastener, the rotational lever at one lever end pivotally holds a cylinder having a threaded aperture penetrating through the cylinder's width, the threaded aperture rotatably engages a portion of the threaded fastener that passes through a double open-ended channel formed by the enclosed second body end.

18. The golf club tool-golf club combination of claim 16 wherein the rotational lever-based compression device further comprises a spring-biased pin-detent mechanism for removably holding the multi-prong fork in one of three positions in relation to the tool body.

19. The golf club tool-golf club combination of claim 18 wherein the spring-biased pin-detent mechanism further comprises a bar movably mounted within a portion of the second enclosed body end, the bar connects to a pin that has removable engagement with multiple detents as formed by the multi-prong fork.

20. The golf club tool-golf club combination of claim 15 wherein the operator grasps the golf club head to bring the golf club tool to proximate to the ground.

* * * * *